US009741248B2

(12) United States Patent
Challapali et al.

(10) Patent No.: US 9,741,248 B2
(45) Date of Patent: Aug. 22, 2017

(54) SYSTEM AND METHOD FOR TRAFFIC MANAGEMENT USING LIGHTING NETWORKS

(71) Applicant: PHILIPS LIGHTING HOLDING B.V., Eindhoven (NL)

(72) Inventors: Kiran Srinivas Challapali, New City, NY (US); Dave Alberto Tavares Cavalcanti, Mahopac, NY (US); Jianfeng Wang, Ossining, NY (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/385,707

(22) PCT Filed: Mar. 26, 2013

(86) PCT No.: PCT/IB2013/052409

§ 371 (c)(1),
(2) Date: Sep. 16, 2014

(87) PCT Pub. No.: WO2013/144846

PCT Pub. Date: Oct. 3, 2013

(65) Prior Publication Data

US 2015/0046074 A1 Feb. 12, 2015

Related U.S. Application Data

(60) Provisional application No. 61/616,569, filed on Mar. 28, 2012.

(51) Int. Cl.
*G08G 1/017* (2006.01)
*G08G 1/13* (2006.01)
(Continued)

(52) U.S. Cl.
CPC ..... *G08G 1/017* (2013.01); *F21S 8/08* (2013.01); *G08G 1/01* (2013.01); *G08G 1/081* (2013.01);
(Continued)

(58) Field of Classification Search
CPC G08G 1/017; G08G 1/01; G08G 1/14; G08G 1/09; G08G 1/13; G08G 1/081; F21S 8/08
(Continued)

(56) References Cited

U.S. PATENT DOCUMENTS

2010/0029268 A1 2/2010 Myer
2011/0015934 A1 1/2011 Rowe
2012/0038490 A1 2/2012 Verfuerth

FOREIGN PATENT DOCUMENTS

CN 101799991 A 8/2010
CN 201690601 U 12/2010
(Continued)

*Primary Examiner* — Brian P Sweeney

(57) ABSTRACT

A lighting network (100) and methods therefore are disclosed. The lighting network (100) includes a plurality of lighting units (LU0-LU10) each including a wireless receiver (12) arranged to obtain a wireless signal from an object (30) to be tracked and a communication interface (14). The lighting network (100) also includes a control unit (20) including a communication unit (22) that is arranged to communicate with at least one of the plurality of lighting units (LU0-LU10) to obtain tracking data based upon the wireless signal. The tracking data is processed by the control unit (20) using a topology table (FIG. 1*b*). The topology table (FIG. 1*b*) is based upon the geographic locations of the plurality of lighting units and mapping data.

15 Claims, 4 Drawing Sheets

(51) Int. Cl.

| | |
|---|---|
| ***G08G 1/01*** | (2006.01) |
| ***G08G 1/09*** | (2006.01) |
| ***G08G 1/14*** | (2006.01) |
| ***F21S 8/08*** | (2006.01) |
| ***G08G 1/081*** | (2006.01) |

(52) U.S. Cl.
CPC ..... *G08G 1/09* (2013.01); *G08G 1/13* (2013.01); *G08G 1/14* (2013.01)

(58) Field of Classification Search
USPC ..... 701/117
See application file for complete search history.

(56) References Cited

FOREIGN PATENT DOCUMENTS

| | | | | | |
|---|---|---|---|---|---|
| JP | 2003178341 | A | | 6/2003 | |
| JP | 2005295380 | A | | 10/2005 | |
| JP | 2006244144 | A | | 9/2006 | |
| JP | 2008097616 | | | 4/2008 | |
| KR | 20020043264 | A | | 6/2002 | |
| KR | 20030000302 | A | | 1/2003 | |
| KR | 2003-0000302 | A | * | 6/2004 | ..... G08G 1/09 |
| WO | 2009012248 | A1 | | 1/2009 | |

* cited by examiner

S400 - one or more LUs receive one or more of the wireless signals (beacons) from one or more of the vehicles
S410 - LUs update the database
S420 - LUs determines if it has transmitted traffic data to the central control unit
S430 - LUs updates/transmits the traffic data to the central control unit
S440 - LUs may periodically and/or automatically (after transmission of the traffic data) purge old information in the database

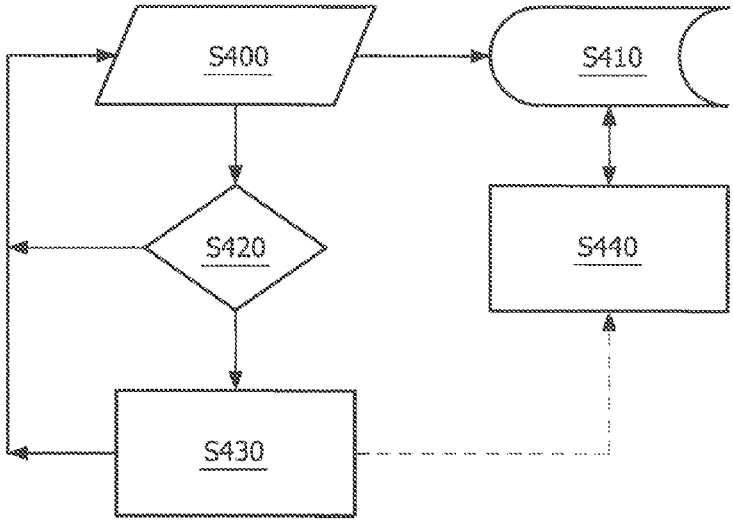

FIG. 4

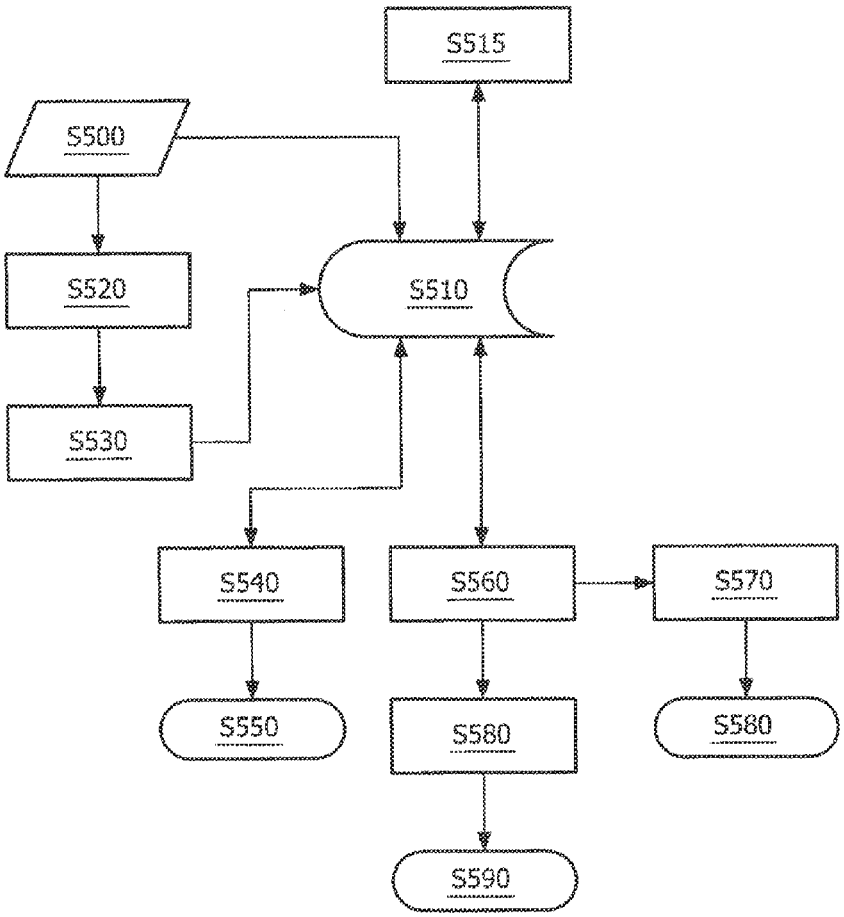

FIG. 5

S500 - central control unit receives the traffic data from one or more of the LUs
S510 - central control unit stores the traffic data in the database
S515 - central control unit periodically purge old data in the database
S520 - central control unit determines the location of vehicles
S530 - the vehicle location on the street is determined/estimated
S540 – store he determined location and time stamp data for each of the vehicles
S550 – determine a tracked path for each of the vehicles
S560 - determine a local speed of each vehicle
S570 – determine an average speed for each of the vehicles
S580 – determine a traffic flow in one or more selected location
S590 – provide the traffic flow to a vehicle

SYSTEM AND METHOD FOR TRAFFIC MANAGEMENT USING LIGHTING NETWORKS

CROSS-REFERENCE TO PRIOR APPLICATIONS

This application is the U.S. National Phase application under 35 U.S.C. §371 of International Application No. PCT/IB2013/052409, filed on Mar. 26, 2013 which claims the benefit of U.S. Provisional Patent Application No. 61/616,569, filed on Mar. 28, 2012. These applications are hereby incorporated by reference herein.

This invention relates to a system and method to manage traffic information and, more particularly, a real-time traffic management system using outdoor lighting networks (OLN) in urban environments where lighting units (LUs) act as listening posts for signals emitted from devices in the urban environment. For example, the signals may be radio frequency signals emitted from automobiles.

Traffic congestion in cities is an increasing problem. Congestion delays have a heavy cost burden. This can be as much as 1% of GDP, more specifically, 1.5% in the UK, 0.9% in Germany, 1.3% in France, and 0.6% in the US based upon recent studies and estimates. This cost burden is projected to increase in the coming years. While building additional or enlarged roadways may help, this will not alleviate the entire problem of traffic congestion.

Smart, intelligent technology and market based management of traffic is needed. For instance, rudimentary congestion pricing is already implemented in some cities around the world, e.g., Singapore, Stockholm, London, and Oslo.

A congestion pricing or congestion charge is a system of surcharging users of a transport network in periods of peak demand to reduce traffic congestion. This may include variable toll-like road pricing fees. This variable pricing strategy regulates demand, making it possible to manage congestion without increasing supply. Market economics theory, which encompasses the congestion pricing concept, postulates that users will be forced to pay for the negative externalities they create, making them conscious of the costs they impose upon each other when driving during the peak demand period, and more aware of their impact on the environment Initial results from these preliminary implementations suggest that a 10 to 30% decrease in traffic due to congestion pricing can be achieved.

In order to implement smart traffic management schemes, it is important to understand the real-time traffic flow in cities in detail. The conventional approach to determine traffic is by installing additional traffic infrastructure. This conventional traffic infrastructure includes sensors that are located under the roadway or attached to roadside infrastructure to measure traffic flow, as well as cameras-based systems to automatically collect toll and detect traffic violations.

The conventional camera and sensor systems can identify automobile license plate numbers, track vehicle speed and connect to users databases to automatically record violations or bill users. Short-range radio-frequency (RF) identification systems (also called RFID, e.g. EZPass in the US) are also used for automatic toll collection at certain locations.

However, this conventional traffic infrastructure is expensive to install and maintain. For example, installing new sensors under the pavement and new toll collection booths is expensive and can only be done at a few strategic locations, e.g. entry points in city and some exits in a highway. Therefore, the granularity of traffic flow information available for cities is limited by the existing traffic monitoring infrastructure.

Other approaches to collect traffic information are based on tracking mobile phone users (e.g. Google map application), but this approach also has accuracy limitations and its availability also depends on the coverage of the mobile phone service. In this regard, if the traffic information is not accurate, this may exacerbate the traffic problems, instead of mitigating them.

Accordingly, a need exists in the art for systems and methods to address the shortcomings of the conventional traffic management systems noted above.

One feature of the present invention is related to using outdoor lighting networks deployed within urban environments and cities to gather dense, real-time traffic information that is necessary for smart traffic control and management. This will improve the granularity and/or the accuracy of traffic flow information. This will also reduce the infrastructure costs of installation and maintenance as compared to the convention systems noted above.

According to the principles of the present invention various embodiments for managing traffic, assisting in real-time traffic management schemes, such as congestion pricing, are disclosed. Wireless signals from cars and other vehicles are detected using outdoor lighting networks ("OLNs"). The lighting units ("LU") within the OLNs act as listening posts for the wireless signals, e.g., radio frequencies signals.

According to aspects of the present invention, since these listening posts (LUs) are networked, information gathered from the LUs can further be aggregated, analyzed and presented to users or traffic management/control systems. This aggregated information can be used by municipalities to manage traffic, for instance, to introduce congestion tax or to perform dynamic traffic light sequencing. This aggregated information can be used broadly, for instance, it may be presented to users, or may be used to predict traffic and direct users.

It is noted that the US Department of Transportation (DoT) is considering mandating a dedicated short range communication ("DSRC") (5.9 GHz or other) radios in every car to increase safety, similar to the mandated seat belts and air bags today. Meanwhile, the U.S. Department of Transportation ("DoT") is already going ahead with basic "Heart beat" or "Here I am" type functions implemented using the DSRC system.

DSRC systems are one-way or two-way short- to medium-range wireless communication channels specifically designed for automotive use and a corresponding set of protocols and standards. In October 1999, the United States Federal Communications Commission (FCC) allocated in the USA 75 MHz of spectrum in the 5.9 GHz band for DSRC to be used by Intelligent Transportation Systems ITS. In Europe in August 2008 the European Telecommunications Standards Institute (ETSI) has allocated 30 MHz of spectrum in the 5.9 GHz band.

Given DSRC radios or other forms of wireless communication in cars, the present invention discloses methods and systems to gather information collected at the roadside from cars and provide traffic flow information (for individual vehicle and collectively) to either the city or other end users that can be used to implement intelligent traffic management systems.

Intelligent traffic management systems configured according the the present invention may include one or more of the following applications:

Determination of traffic density and flow (speed) for intelligent traffic management;

Dynamic traffic light sequence;

Congestion pricing;

Automatic speed enforcement without special infrastructure that could furthermore be location specific (e.g. school area);

Violations such as illegal school bus crossing could be automatic tracked;

Localization of vehicles, for instance stolen vehicles, or for law enforcement applications;

Automatic detection of emergency safety situations, such as the notification to authorities of a car driving in the wrong direction on a road or highway;

Safety conditions, such as a vehicle driving on the wrong side of the road can be identified earlier together with an alert/alarm; and/or Availability/occupancy of parking on a street or in a lot, as well as facilitate metering/billing for the parking (e.g., replacing parking meters).

In one embodiment, the present invention relates to a lighting network includes a plurality of lighting units. Each lighting unit includes a wireless receiver arranged to obtain a wireless signal from an object to be tracked and a communication interface. The lighting network also includes a control unit. The control unit includes a communication unit that is arranged to communicate with at least one of the plurality of lighting units to obtain tracking data based upon the wireless signal and to process the tracking data using a topology table. The topology table is based upon geographic locations of the plurality of lighting units and mapping data.

In another embodiment, the present invention relates to a controller to be used in a lighting network including a plurality of lighting units. The controller includes a communication unit arranged to receive traffic data, related to a vehicle, from at least one of the plurality of lighting units. The controller also includes a processor arranged to process the traffic data using a topology table to determine traffic related information in a predetermined area. The topology table is based upon geographic locations of the plurality of lighting units and mapping data.

In yet another embodiment, the present invention relates to a method to determine the traffic information. The method includes the steps of receiving a plurality of beacon signals from a plurality of lighting units related to a particular vehicle, removing one or more of the plurality of beacon signals if a particular beacon signal is below a predetermined threshold and determining a street the particular vehicle is located on using a topology table and the plurality of beacon signals. The topology table is based upon the geographic locations of the lighting units and street data for a region the plurality of lighting units are located in. The method also includes the step of estimating a location of the particular vehicle along the street based upon the plurality of beacon signals.

In general, the various aspects and embodiments of the present invention may be combined and coupled in any way possible within the scope of the invention. The subject matter that is regarded as the invention is particularly pointed out and distinctly claimed in the claims at the conclusion of the specification.

The foregoing and other features and advantages of the invention will be apparent from the following detailed description taken in conjunction with the accompanying drawings.

FIGS. 1*a* and 1*b* show a traffic management system 100 according to an embodiment of the invention.

FIG. 4 shows a traffic data gathering method according to another embodiment of the invention.

FIG. 5 shows a traffic data processing method according to another embodiment of the invention.

Figure 1:
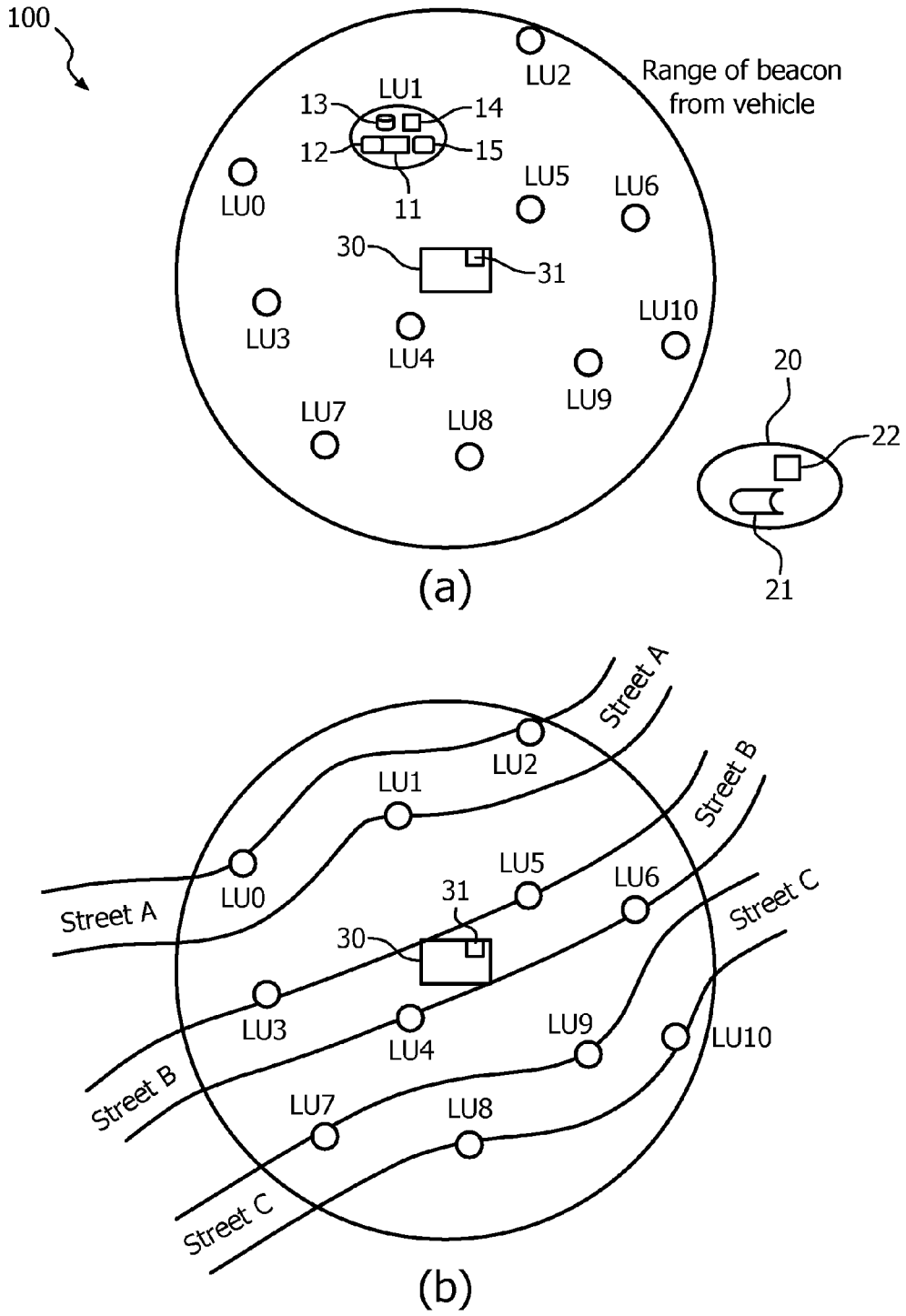

As shown in FIG. 1*a*, a traffic management system 100 includes a central control unit 20 and one or more lighting units (e.g., LU0-LU10). The central control unit 20 may be located near or at a remote location from the LUs (LU0-LU10). The central control unit 20 includes a database 21 and a communication unit 22. The communication unit 22 is used to communicate with the LUs (LU0-LU100 and may also be used to provide access to traffic information for a user or external system. The central control unit 20 is communicatively coupled to the LUs (LU0-LU10), either directly or indirectly. For example, the central control unit 20 may be in direct communication via a wired and/or wireless/wireless-mesh connection or an indirect communication via a network such as the Internet, Intranet, a wide area network (WAN), a metropolitan area network (MAN), a local area network (LAN), a terrestrial broadcast system, a cable network, a satellite network, a wireless network, or a telephone network (POTS), as well as portions or combinations of these and other types of networks.

The LUs (LU0-LU10) include a light producing mechanism 11, a wireless receiver 12 to detect wireless signals, an optional database 13 and a communication interface 14. The wireless receiver 12 may be, for example, compatible with DSRC, 3G, LTE, WiFi, RFID, another type of wireless communication system or a visual light communication system may be used. The communication interface as noted above may any suitable communication arrangement to transfer data to the central control unit 20. In this regard, via the communication interface 14, each LU is in communication with the central control unit 20 directly and/or via another LU and/or via an intermediate node (not shown in FIGS. 1*a* and 1*b*). The intermediate node may be a data collection/processing unit for a particular sub-traffic zone in the traffic management system 100. The intermediate node may include some or all of the functionality of the central control unit 20.

The database 13 need not be included in all of the LUs (LU0-LU10). Since the LUs (LU0-LU10) may communicate with one or more other LUs and/or the intermediate node, any data that would need to be recorded or stored can be stored in another LU and/or the intermediate node as needed.

Figure 2:
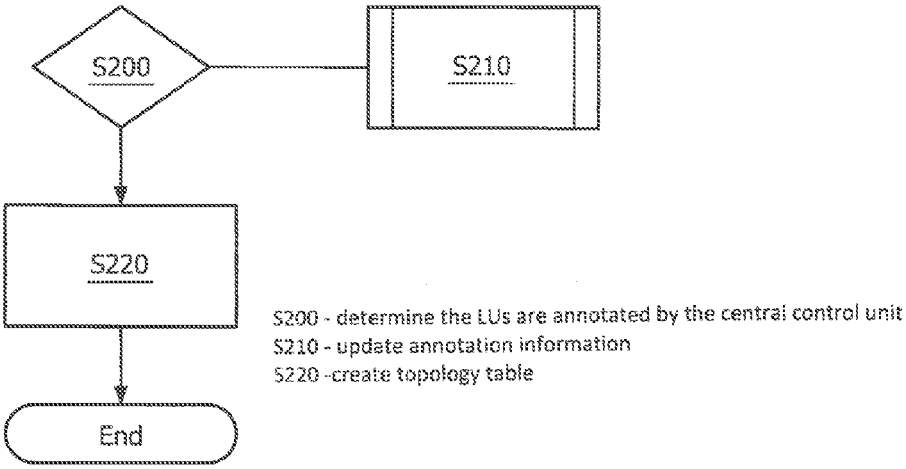
FIG. 2 shows an initialization method of according to an embodiment of the present invention.
Figure 3:
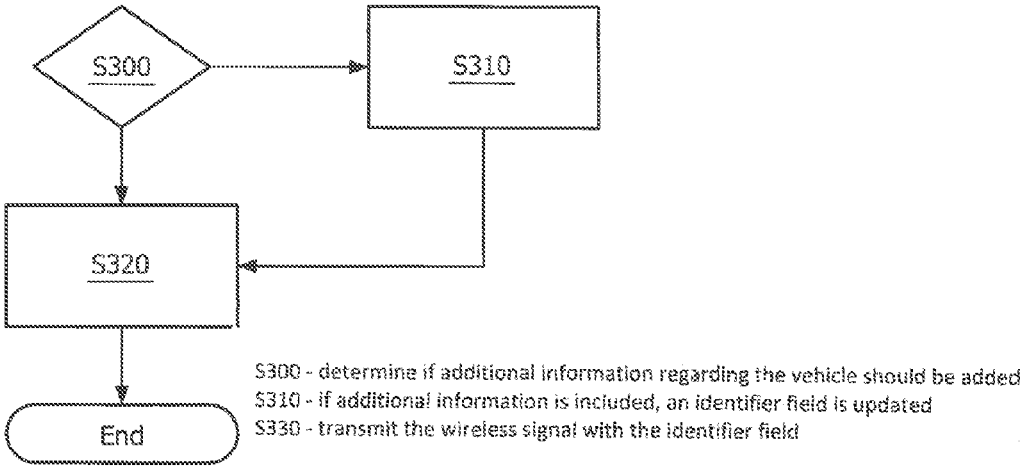
FIG. 3 shows a vehicle identification method according to another embodiment of the present invention.

In operation, the traffic management system 100 performs various functions as needed for the particular traffic management requirements. FIGS. 2-4 are exemplary methods implementing various functions that may be performed.

FIG. 2 shows an initialization method according to an embodiment of the present invention. In step 200, a determination is made as to whether all the LUs (LU0-LU10) are annotated by the central control unit 20. For each LU (LU0-LU10), annotation data is stored that includes one or more of the following information: a unique identification code, geographic location and street location/name. Other information may also be stored for each LUs to assist in the various functions performed by the traffic management system 100. If the central control unit 20 does not have annotation information for all LUs in communication with the central control 20, the annotation information is updated and recorded as needed in step 210. This may be done by accessing an appropriate database and/or from information provided by the respective LU. In addition, the annotation information may be provided by a user or another device such as a commissioning tool assistant device carried by an installer or other person in the field that can input the annotation information.

In step 220, a topology table is created for LUs in the city zone or traffic zone. The topology table is based upon the geographic location of the LUs (LU0-LU10) and mapping data such as street names and street paths. A visual representation of data in the topology table is shown in FIG. 1*b*. The size of the table is L×L, where L is the number of LUs (LU0-LU10) in the city or the traffic zone. The creation of the topology table may be performed by the central control unit 20 or by an adjunct processing unit. The topology table may also include a correlation with the annotation information and other database information maintained by other information systems, e.g., GPS location systems, street mapping/direction data and systems, school bus routes, etc. The topology table may also provide distance data such as which LUs are within range ("R") of a DSRC radio signal (e.g. a value of "1") and which LUs are not within range (e.g., a value of "0").

With reference to FIGS. 1*a* and 1*b* again, each vehicle 30 or object to be tracked/monitored in the traffic management system 100 includes a wireless transmitter 31 that transmits a wireless signal that is detected by one or more of the LUs (LU0-LU10). The wireless signal includes at least an identification code for the vehicle 30. The identification code for the vehicle 30 is sufficient to detect traffic volume. Additional information may also be included in the wireless signal such as traffic data to be processed by the traffic management system 100 to allow for more advanced applications as discussed herein.

FIG. 3 shows a method for updating/adding additional information related to a particular vehicle, in the wireless signal, to facilitate functionality of the traffic management system 100. For each of the vehicles 30, in step 300, a determination is made as to whether additional information should be added, e.g., a school bus or emergency response vehicle or a type of vehicle within a particular group (a rental car company). This determination may be skipped if no additional information is to be added. This determination may also be done at anytime, for example, by a driver of the vehicle 30 or preprogrammed beforehand. In step 310, if additional information is to be included, an identifier field is updated and added to the wireless signal (e.g., DSRC beacon signal). In step 330, the wireless signal with the identifier field is transmitted. This transmission may be periodic, polled or continuous depending on requirements of communication protocols implemented in the traffic management system 100.

FIG. 4 shows a traffic data gathering method performed by the LUs (LU0-LU10) according to yet another embodiment of the invention. In step 400, one or more LUs (LU0-LU10) receive one or more of the wireless signals (beacons) from one or more of the vehicles 30. In step 410, the LU(s) update the database 13 (within the LU and/or in another LU and/or in the intermediate node). In one embodiment, the database 13 may also be remotely maintained at the central control unit 20. Some LUs may also keep a local database, while other LUs may be used mainly as relay nodes if a mesh network is used to provide data to the central control unit 20. The updating may include adding a new vehicle ID, maintaining an existing vehicle ID and including/updating time-stamps for the vehicle(s) 30 for which the wireless signal(s) have been received. The exact data to be included/updated depends on the functionality to be performed by the traffic management system 100. In step 420, the LU determines if it has transmitted traffic data to the central control unit 20. This determination may be based upon periodically transmitting the traffic data every "T" minutes (an update interval) where the frequency of "T" may vary depending the on the functionality to be performed by the traffic management system 100. The determination may also, for example, be based upon an update request from the central control unit 20 or a trigger based upon an update of the database 13. Based upon the determination in step 430, the LU updates/transmits the traffic data to the central control unit 20. This traffic data may include the vehicle(s) 30 IDs, time-stamp information, GPS data, signal-levels of the wireless signal, geographical location and identification code of the LU. In step 440, the LU may periodically and/or automatically (after transmission of the traffic data) purge old information in the database 13.

As shown in FIG. 1, the central control unit 20 is configured to compute the traffic information at periodic intervals, which may be set depending on the required accuracy for the information. In one embodiment, to get accurate vehicle speed and position, the update interval from the LUs could be set to the shortest period between the wireless signals (i.e., beacon) transmissions by the vehicles 30. In this case, the central control unit may use every wireless signal (beacon) transmission to update the traffic flow information.

In another embodiment, the update interval may be set to a few seconds or minutes and/or be changeable. For example, the update interval can be adjusted by the central control unit 20 based on traffic conditions and/or in response to a given vehicle. For example, to track a suspicious vehicle, the central control unit can poll the LUs (LU1-LU10) to report the suspicious vehicle immediately upon receiving its associated wireless signal (beacon). In addition, the central control unit 20 may be configured to adapt to the traffic needs of the city region by region, based for instance on traffic density in that region or the accuracy/granularity of the traffic information needed for that region in order to efficiently manage the traffic.

Some of the applications/functionality discussed above are summarized in the table 1 below.

TABLE 1

| | Vehicle owners | Govt: City/ DoT/Police | Traffic Management System 100 functionality |
|---|---|---|---|
| Monitoring | Real-time Traffic flow information Routing data. | Long term road planning Congestion control | Determination of traffic density and flow (speed). Dynamic traffic light sequence. |
| Vehicle tracking (identify individual car speeds, location and time) | General safety | Public safety and law enforcement Congestion control Toll collection. | Automatic speed enforcement could be location specific (e.g. school area) Illegal school bus crossing Localization of vehicle (e.g. stolen, law enforcement). Moving violations, e.g, driving in the wrong direction. |

FIG. 5 shows one example of a traffic data processing method performed by the central control unit 20 according to the present invention. In particular, FIG. 5 shows how to determine traffic density and flow (speed) which may be provided to drivers on the road or other users of the traffic management system 100. In step 500, the central control unit 20 receives the traffic data from one or more of the LUs (LU0-LU10). In step 510, the central control unit 20 may store the traffic data in the database 21 or other temporary/permanent storage means. In step 515, if needed to free storage space, the central control unit 20 may periodically purge old data in the database 21.

In step 520, based upon the traffic data from the LUs (LU0-LU10) and the topology table (discussed above), the central control unit 20 determines the location, e.g., street, that each of the vehicles 30 are located/traveling on. This can be done, for example, for each of the vehicles 30 by computing the average received signal strength for each street and selecting the street based on the maximum average for at least two of three wireless signal (beacon) events. For example, as shown in FIG. 1*b*, from the topology table, it is known that LU0-LU2 are located on Street A and LU3-LU6 are located on Street B. An average received signal strength (from LU0-LU2) for Street A and Street B (from LU3-LU6) can be computed to determine that the vehicle 30 is located on Street B.

This type of algorithm to select which street the vehicle 30 is on is based on temporal and spatial averaging which are both limited to within street LUs. Preprocessing of the data may be done to remove wireless signal data that is weaker than a predetermined threshold. This may help improve the accuracy of the selection.

In step 530, the location on the street, from in step 520, is determined/estimated. This is done based upon a weighted sum function of signal strengths received at the LUs within the street. In this case, the vehicle 30 would be estimated at the position of the LU that received the strongest wireless signal from the vehicle 30. The determined location, time stamp, etc. data for each of the vehicles 30 may be recorded in the database 21. In step 540, the determined location and time stamp data for each of the vehicles 30 may be sorted by increasing time. In step 550, a tracked path for each of the vehicles 30 may be determined using the stored traffic data and the topology table.

In step 560, based upon the determined location data and associated time stamp data, for each of the vehicles 30, a local speed can be determined. This is based upon the time difference between two sequential location determinations and the known distances between the LUs (LU0-LU10). In step 570, an average speed for each of the vehicles 30 is determined from an average of the local speeds determined in step 560. In step 580, the average speed for each of the vehicles 30 can be provided.

In step 580, a traffic flow in one or more selected location (e.g., a street intersection) is determined. This can be determined by computing an average number of the vehicles 30 in the one or more selected locations in a predetermined time interval (e.g., a few seconds to a few minutes). The exact time interval will depend on the typical/ideal traffic conditions to be monitored at the selected location. In step 590, the determined traffic flow for the one or more selected locations can be provided.

In another embodiment, traffic information that is computed and/or determined (e.g., the traffic flow in step 590 or the average speed in step 580) by the central control unit 20 may be provided to the vehicle 30 via the LUs (LU0-LU10).

It should be understood by one of ordinary skill that the method described and shown in FIG. 5 may be adjusted and/or other methods may be used to allow the traffic management system 100 to provide other information. This other information can be used, for example, to control the sequence of traffic lights dynamically. Furthermore, the other information can be used to track individual vehicles, to enforcement of speed limits, to locate lost or stolen vehicles and quickly identify a vehicle driving in the wrong side of the road and to take necessary remedial action. In addition, the other information can be used to identify illegal school bus crossings and to identify the vehicle 30's owner (i.e. for traffic violation purposes), thus increasing safety.

In order to enable verification/validation of traffic violations for certain applications listed above, in another embodiment, the traffic management system 100 can also include image (video/picture) capturing devices (not shown) embedded in the LUs (LU0-LU10). The traffic management system 100 may also interact with image capturing devices using the traffic management system 100 as communication infrastructure or through a third party infrastructure. The traffic management system 100 can retrieve data from the image capturing devices in a given location when a traffic violation event is determined by the traffic management system 100 while analyzing the traffic data collected from the vehicles 30 according to the methods described above.

In another embodiment, identification and tracking of the vehicles 30 illegally passing a school bus can be determined as follows. When the school bus stops and its stop signal is deployed, a predetermined ("stop beacon") signal may be sent by the wireless transmitter 31 in the school bus. The LUs (LU0-LU10) in range of the wireless signal would detect and forward the predetermined signal to the central control unit 20 with the time stamp data. By correlating the bus stop event (identified through the stop beacon signal from the school bus) with the wireless signal data from the vehicles 30 in area, the central control unit 20 can track the vehicles 30 speed and location (with reference to the methods described above) and determine/record violations. The traffic management system 10 may also request images from any connected devices available in the area at the time of the bus stop/illegal passing event.

In yet another embodiment, a sensor 15 may be installed on one or more the LUs (LU0-LU10) to detect an occupancy status of parking lots or on streets. The sensor 15 may be, for example, a camera or infrared sensor. The sensor 15 can monitor one or more parking lots around the LU. In one example, an image processing algorithm may be used to detect the occupancy status by comparing a first known image without vehicles within the parking lot or street and a second image. If there is a significant difference between the two images, this indicates a determination of the occupancy status. Such vehicle detection algorithms can be used together with camera sensors. Alternatively, a remote sensor can also be installed in or around the parking lot which can communicate, via the wireless receiver 12, with the LUs (LU0-LU10) about the occupancy status of the parking lots.

In this embodiment, the LUs (LU0-LU10) transmit messages including availability information of parking lots nearby to other LUs and/or to the central control unit 20. Each LU can store information in the database 13 about parking lots within a certain distance. The central control unit 20 may also maintain information in the database 21 for all of the monitored parking lots.

In operation, a driver or passenger in the vehicle 30 may request parking availability information through the wireless transmitter 31 in the vehicle 30. The request is received by one or more LUs and sent to the central control unit 20. When the central control unit 20 receives the request, it first uses the identification code for the vehicle 30 to query the traffic data in the database 21. This can be done to find the closest LU (and parking lot) to the vehicle 30. In this regard, the central control unit 20 uses the stored traffic data to query the parking availability database, and send a message back to the vehicle 30 that includes the parking availability information around the vehicle 30. The message can also include route information for the vehicle to follow to arrive at those parking lots. If LUs (LU0-LU10) receive such a parking request from the vehicle 30 and the LUs are equipped with the database 13 about available parking lot information nearby, the LU can send a message directly back the vehicle 30 about the parking occupancy.

In the above embodiment, the wireless transmitters 31 functions both as a transmitter and receiver. The wireless transmitter 31 further includes an output device to visually and/or audibly output the message response.

In yet another embodiment, once the vehicle 30 arrives at an appropriate parking location, based upon the message, the driver/user may interact with the traffic management system 100 (e.g. via the wireless transmitter 31) to register and/or pay for the parking. The LUs (LU0-LU10) would track occupancy as described above and can also detect any violations of overtime/allowed time for parking. The traffic management system 100 can also provide the driver/user with a confirmation/registration message for the parking.

The foregoing detailed description has set forth a few of the many forms that the invention can take. The above examples are merely illustrative of several possible embodiments of various aspects of the present invention, wherein equivalent alterations and/or modifications will occur to others skilled in the art upon reading and understanding of the present invention and the annexed drawings. In particular, regard to the various functions performed by the above described components (devices, systems, and the like), the terms (including a reference to a "means") used to describe such components are intended to correspond, unless otherwise indicated to any component, such as hardware or combinations thereof, which performs the specified function of the described component (i.e., that is functionally equivalent), even though not structurally equivalent to the disclosed structure which performs the function in the illustrated implementations of the disclosure.

The principles of the present invention are implemented as any combination of hardware, firmware and software. Moreover, the software is preferably implemented as an application program tangibly embodied on a program storage unit or computer readable storage medium consisting of parts, or of certain devices and/or a combination of devices. The application program may be uploaded to, and executed by, a machine comprising any suitable architecture. For example, the LUs (LU0-LU10) and the central processing unit 20 may be implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such computer or processor is explicitly shown. In addition, various other peripheral units may be connected to the computer platform such as an additional data storage unit and a printing unit.

Although a particular feature of the present invention may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising".

The present invention has been described with reference to the preferred embodiments. However, modifications and alterations will occur to others upon reading and understanding the preceding detailed description. It is intended that the present invention be construed as including all such modifications and alterations. It is only the claims, including all equivalents that are intended to define the scope of the present invention.

The invention claimed is:

1. A lighting network comprising:

a plurality of lighting units each including (1) a wireless receiver arranged to obtain a beacon signal from an object to be tracked within an area and (2) a communication interface; and a control unit, remote from the plurality of lighting units, the control unit including a communication unit that is arranged to communicate with at least one of the plurality of lighting units, determine tracking data related to the object using only the beacon signal received by two or more lighting units and a topology table, where in the topology table is based upon geographic locations of the plurality of lighting units and mapping data of the area including street data information, and implement a traffic management scheme based on the tracking data in the area by adjusting a lighting strategy of at least one of the plurality of lighting units.

2. The lighting network according to claim 1, wherein the control unit further uses signal strength of two or more received beacon signals to determine the tracking data and the topology table to determine a street that the object is located.

3. The lighting network according to claim 2, wherein the beacon signal further includes at least one of an object ID, time-stamp information, or a signal-level.

4. The lighting network according to claim 2, wherein the wireless receiver is a DSRC signal receiver.

5. The lighting network according to claim 4, wherein the object to be tracked is a vehicle and the tracking data is processed to determine traffic information that is provided back to the vehicle via the DSRC signal receiver.

6. The lighting network according to claim 1, wherein at least one of the plurality of lighting units further includes a sensor that gathers data to be used to determine availability of parking for the vehicle.

7. The lighting network according to claim 6, wherein the control unit is further arranged to process the data from the sensor to provide a parking availability message to the vehicle via one or more of the plurality of lighting units.

8. The lighting network according to claim 7, wherein the control unit is further arranged to process a request from the vehicle to pay and/or register for a parking space via the one or more of the plurality of lighting units.

9. The lighting network according to claim 8, wherein the control unit is further arranged to track occupancy of the parking space for a parking violation via the one or more of the plurality of lighting units.

10. A controller to be used in a lighting network including a plurality of lighting units, the controller being remote from the plurality of lighting units, said controller comprising:

a communication unit arranged to receive a beacon signal, related to a vehicle, from at least one of the plurality of lighting units;

a processor arranged to determine tracking data related to the vehicle within an area using only the beacon signal received by two or more lighting units and a topology table, wherein the topology table is based upon geographic locations of the plurality of lighting units and mapping data of the area including street data information and implement a traffic management scheme based on the tracking data in the area by adjusting a lighting strategy of at least one of the plurality of lighting units.

11. The controller according to claim 10, wherein the tracking data includes at least one of the following a projected path for the vehicle, a traffic flow for a predetermined location, or an average speed of the vehicle.

12. A method to determine traffic information, the method comprising the steps of:

receiving, in a lighting unit, a plurality of beacon signals generated by a transmitter in a vehicle;

determining, in a controller that is remote from the plurality of lighting units, a street the particular vehicle is located on using a topology table and the plurality of beacon signals, where the topology table is based upon the geographic locations of the lighting units and street data for a region the plurality of lighting units are located in; and estimating a location of the particular vehicle along the street based upon the plurality of beacon signals and implement a traffic management scheme based on the tracking data in the area by adjusting a lighting strategy of at least one of the plurality of lighting units.

13. The method according to claim 12, further comprising the step of computing a tracking path for the particular vehicle based on a plurality of the locations from the estimation step and associated time stamp information for each of the plurality of locations.

14. The method according to claim 12, further comprising the step of computing an average speed of the particular vehicle based on a plurality of the locations from the estimation step and associated time stamp information for each of the plurality of locations.

15. The method according to claim 12, further comprising the step of computing a traffic flow in an area based upon an average number of vehicles passing through the in a fixed interval.

* * * * *